US006591649B1

(12) United States Patent
Gafri et al.

(10) Patent No.: US 6,591,649 B1
(45) Date of Patent: Jul. 15, 2003

(54) METHOD AND APPARATUS FOR PULSED DISCHARGE FORMING OF A DISH FROM A PLANAR PLATE

(75) Inventors: Oren Gafri, Rishon-Le-Zion (IL); Yuri Livshiz, Rishon-Le-Zion (IL)

(73) Assignee: Pulsar Welding Ltd., Yavne (IL)

( * ) Notice: Subject to any disclaimer, the term of this patent is extended or adjusted under 35 U.S.C. 154(b) by 0 days.

(21) Appl. No.: 09/582,652

(22) PCT Filed: Dec. 29, 1998

(86) PCT No.: PCT/IL98/00628

§ 371 (c)(1),
(2), (4) Date: Sep. 13, 2000

(87) PCT Pub. No.: WO99/33590

PCT Pub. Date: Jul. 8, 1999

(30) Foreign Application Priority Data

Dec. 29, 1997 (IL) ..... 122795

(51) Int. Cl.[7] ..... B21D 26/12; B21D 26/06

(52) U.S. Cl. ..... 72/56; 72/63; 29/421.1; 29/421.2

(58) Field of Search ..... 72/56, 55, 63; 29/421.1, 421.2

(56) References Cited

U.S. PATENT DOCUMENTS

| | | | | |
|---|---|---|---|---|
| 3,188,844 A | | 6/1965 | Schwinghamer | |
| 3,222,902 A | * | 12/1965 | Brejcha et al. | 29/421.2 |
| 3,225,578 A | * | 12/1965 | Krieger | 72/56 |
| 3,228,222 A | | 1/1966 | Maier | |
| 3,232,086 A | * | 2/1966 | Inoue | 29/421.2 |
| 3,267,710 A | * | 8/1966 | Inoue | 29/421.1 |
| 3,267,780 A | * | 8/1966 | Roth | 72/56 |
| 3,358,487 A | | 12/1967 | Brejcha et al. | |
| 3,566,647 A | * | 3/1971 | Inoue | 72/56 |
| 3,654,787 A | | 4/1972 | Brower | |
| 3,742,746 A | * | 7/1973 | Erlandson | 72/56 |
| 3,961,739 A | | 6/1976 | Leftheris | |
| 4,170,887 A | | 10/1979 | Baranov | |
| 4,531,393 A | | 7/1985 | Weir | |
| 4,807,731 A | | 2/1989 | Collins | |
| 5,353,617 A | | 10/1994 | Cherian et al. | |
| 5,442,846 A | | 8/1995 | Snaper | |

FOREIGN PATENT DOCUMENTS

| | | |
|---|---|---|
| FR | 2 570 303 | 3/1986 |
| WO | 97 22426 | 6/1997 |

* cited by examiner

*Primary Examiner*—David Jones
(74) *Attorney, Agent, or Firm*—Browdy and Neimark, P.L.L.C.

(57) ABSTRACT

An apparatus for forming a generally planar metal plate into a dish with a three-dimensional pattern is provided. The apparatus comprises a mold having a forming surface with a contour corresponding to said three-dimensional pattern, and having edges corresponding to boundaries of the dish, which edges are defined by side walls essentially perpendicular to the forming plane; a forming device comprising a fluid basin and pairs of electric discharge members within the fluid and having an opening facing the mold to allow transmission of a pressure wave from the fluid to the metal plate; and an electric discharge circuitry for discharging a short and intense electric current through the pairs of electric discharge members generating an electric spark or breakdown within the fluid to yield formation of plasma, vapor or both.

7 Claims, 7 Drawing Sheets

METHOD AND APPARATUS FOR PULSED DISCHARGE FORMING OF A DISH FROM A PLANAR PLATE

CROSS REFERENCE TO RELATED APPLICATION

The present application is the national stage under 35 U.S.C. 371 of PCT/IL98/00628, filed Dec. 29, 1998.

FIELD OF THE INVENTION

The present invention is generally in the field of forming and provides an apparatus and method for such forming. More particularly, the present invention relates to such apparatus wherein the forming force is generated by a rapid discharge of an electric pulse.

BACKGROUND OF THE INVENTION

Metal objects can be formed to have a desired shape by a variety of processes. For example, metal in a liquid form, can be molded to have the desired final shape. However, such a process is applicable in certain specific cases and in addition requires the expense of a large amount of energy and complicated and costly installations for heating and cooling.

Metal has some pliability and accordingly metalwork pieces of one shape can at times be formed to have another shape. For example, a metal plate can be formed and cut to have a wide variety of desired shapes by using a mechanical press. Such pressing methods require a very costly and large installations required for achieving the necessary pressure for attaining the desired final object.

PMF is a process in which a metal workpiece or a portion thereof is put into a rapid motion by pulse magnetic fields which causes the workpiece to deform. One advantage of the PMF process is in that energy loss in this process is minimal and consequently there is no or very little heating of the workpiece. In addition, this process does not have the disadvantage of leaving tool marks, as is the case in a variety of other techniques. The PMF process uses a discharge capacitor or a bank of capacitors, a forming coil and often a field shaper, for creating an intense transient magnetic field. Very intense magnetic fields created in the PMF process, is a result of the rapid discharge of electric energy, stored in the capacitors, through the forming coil. The resulting eddy currents that are induced in the workpiece yields a magnetic repulsion between the workpiece and the forming coil, which cause the workpiece to deform.

A background on prior art apparatuses and methods for working of metal workpieces by the PMF process can be found in U.S. Pat. Nos. 3,654,787, 3,961,739, 4,170,887, 4,531,393, 4,807,731, 5,353,617 and 5,442,846, and in PCT Application Publication No. WO 97/22426.

Pulsed discharge forming (PDF) is a process whereby an electric spark or breakdown is discharged through a fluid particularly liquid which gives rise to plasma and/or vapor formation and this generates a shock wave within the liquid. PDF has been used for a variety of procedures requiring generation of an abrupt pressure wave for performance of work such as rock blasting, etc. Furthermore, PDF has also been applied for a variety of industrial processes.

When forming a shaped metal object from a planar metal plate, it is necessary at times to both shape the plate to require a desired three-dimensional pattern and to trim the edges so as to define the boundaries of the shape metal object.

It is an object of the invention to provide an apparatus and process for forming a metal plate into a dish having a desired three-dimensional pattern and shape.

GENERAL DESCRIPTION OF THE INVENTION

The present invention provides an apparatus for forming a generally planar metal plate into a dish with a three-dimensional pattern, the apparatus comprising:

- a mold having a forming surface with a contour corresponding to said three-dimensional pattern, and having edges corresponding to boundaries of the dish, which edges are defined by side walls essentially perpendicular to the forming plane;
- a forming device comprising a fluid basin and pairs of electric discharge members within the fluid and having an opening facing the mold to allow transmission of a pressure wave from the fluid to the metal plate; and
- an electric discharge circuitry for discharging a short and intense electric current through the pairs of electric discharge members generating an electric spark or breakdown within the fluid to yield formation of plasma, vapor or both.

The formation of plasma or vapor within the fluid basin generates a pressure wave which impacts on the metal plate causing it to deform and assume a three-dimensional pattern defined by the mold. In the process, peripheral portions are sheared along said edges of the mold.

The fluid in the basin is preferably a liquid, particularly an aqueous solution.

In accordance with another aspect there is provided a method for forming a generally planar metal plate into a dish with a three-dimensional pattern, comprising:

(a) providing a mold having a forming surface with a contour corresponding to said three-dimensional pattern, and having edges corresponding to boundaries of the dish, which edges are defined by side walls essentially perpendicular to the forming plane;

(b) placing the metal plate over the forming surface of the mold;

(c) providing a forming device comprising a fluid basin and pairs of electric discharge members within the fluid and having an opening facing the mold, the pairs of electric discharge members being connected to an electric discharge circuitry; and (d) inducing said electric discharge circuitry to discharge a short pulse of an intense electric current through each of the pairs of electric discharge members, thus generating an electric spark or breakdown within the fluid creating a pressure wave in said fluid basin which impacts on and deforms the metal plate against said mold.

As will be appreciated, the sequence order of steps (a), (b) and (c) may be changed, e.g. to sequence (a)-(c)-(b) or (c)-(b)-(a) or (c)-(a)-(b), etc.

In accordance with an embodiment of the invention, the dish has a central concave depression, serving as a template for a central concave portion of the dish. The peripheral portion of the mold in this case may be generally planar thus defining a skirt portion of the dish. The peripheral portions of the mold may also comprise depressions, e.g. annular depressions, thus defining patterns in the skirt portions of the dish. A non-limiting example of a dish of this kind is that which is intended for use as an antenna, e.g. a satellite dish.

As a result of the pulsed discharge of current through the pairs of electric discharge members, portions of the metal plate are induced into a very rapid movement giving rise to either forming or shearing. Where the rapidly moving metal surface moves into a depression, any gasses which remain in the depression can resist the movement and prevent the obtaining of the desired shape defined by the mold, which is particularly problematic in the case of a large depression, e.g. in the case of the central concave depression of the embodiment mentioned above. Accordingly, in accordance with one preferred embodiment, gas ducts are provided to allow egression of gasses from one or more depressions in the mold. Preferably, such ducts are connected to a vacuum source, whereby all the gasses are removed prior to the generation of the pulsed magnetic force.

In accordance with an embodiment of the invention, the metal plate to be deformed is placed directly against the opening of the fluid basin. In accordance with another embodiment of the invention, the opening of the fluid basin is sealed by a flexible wall which transmits the shock wave to the metal plate.

In accordance with an embodiment of the invention, the apparatus comprises a planar forming coil member arranged so as to define a frame around the opening of the fluid basin for deforming a peripheral portion of the plate. Such a coil member is connected to a discharge circuit for discharging an intense electric current therethrough. For example, the coil member may be situated opposite the edges of the mold.

In accordance with an embodiment of the invention, each pair of discharge members consists of a pair of electrodes within the basin. In accordance with another embodiment, each pair of discharge members consists of two poles of a co-axial electrode. In accordance with yet another embodiment the pair of discharge members consists of the wall of the fluid basin and an electrode , whereby the electric discharge is between the electrode and said wall.

The apparatus may comprise any number of pairs of discharge members. For example, the apparatus may comprise two discharge members, three, four, six, eight, etc. In the case of a plurality of pairs of discharge members, all pairs may be connected to the same discharge circuitry, in which case current is discharged simultaneously through all electrodes; or alternatively, each pair may be connected to a different discharge circuitry. In the latter case, the discharge through all pairs may be simultaneous; or, preferably, the discharge may be timed to yield a predetermined discharge sequence.

As may be appreciated, the generated pressure wave impacting the metal plate yields a different force at different portions of the plate. In order to achieve an essentially uniform force over the entire surface of the plate situated at the opening, the electric discharge within the fluid may be generated essentially simultaneously from a number of pairs of discharge members distributed throughout the fluid basin. This results in that a number of pressure waves or an essentially uniform pressure front, which is a combination of individual pressure waves impacts the metal plate yield an essentially uniform forming force over the entire said portion. At times, however, it is desired to apply a forming force sequentially at different portions of the plate. This may be achieved, in accordance with an embodiment of the invention, by providing each of a plurality of pairs of electric discharge members with an independent electric discharge circuitry and then discharging an electric current pulse sequentially through different pairs.

The present invention further provides, by another of its aspects, a force generating device comprising a fluid basin with electric discharge members disposed therein which are connected to a discharge circuitry for discharging a rapid and intense electric current therethrough to generate an electric spark or breakdown between pairs of such members yielding pressure shock wave within the fluid; characterized in that the discharge circuitry comprising a capacitor battery connected at its one pole to at least one discharge member of a pair of such members and at its other pole to both one pole of a power supply and to one pole of a discharge switch; the other pole of the discharge switch being connected to the other discharge member of said pair and to the other pole of said power supply.

The above force generating device may, for example, serve as the forming device in any of the above apparatuses.

In the following, the invention will be described in a non-limiting manner with reference to the annexed drawings.

DETAILED DESCRIPTION OF SPECIFIC EMBODIMENTS

Figure 1:
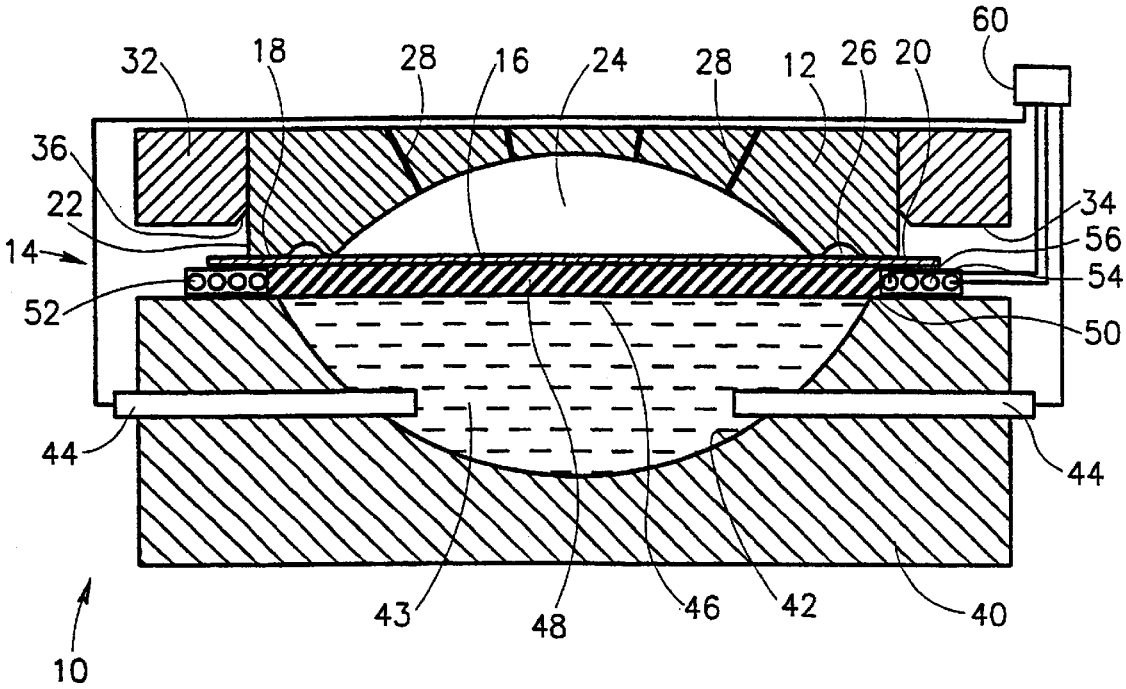
FIG. 1 is a schematical cross-section through a forming apparatus in accordance with an embodiment of the invention, prior to forming the metal plate.

Reference is first being made to FIG. 1 showing an apparatus generally designated 10 comprising a mold 12 and a force generating assembly 14 holding between them a metal plate 16.

Mold 12 has a forming surface 18 of a generally circular shape with edges 20 defined by upright walls 22 with a central dome-shaped depression 24 and an annular groove 26. As will be appreciated, the specific shape of the mold which defines the shape of the dish to be formed in the apparatus is an example only and it may assume also a variety of other shapes. By way of illustration, the mold may have an overall rectangular shape, may have different kinds of depressions for forming dishes with different three-dimensional patterns, etc. Thus the specific illustrated embodiment does not derogate from the generality of the invention as defined herein.

Figure 2:
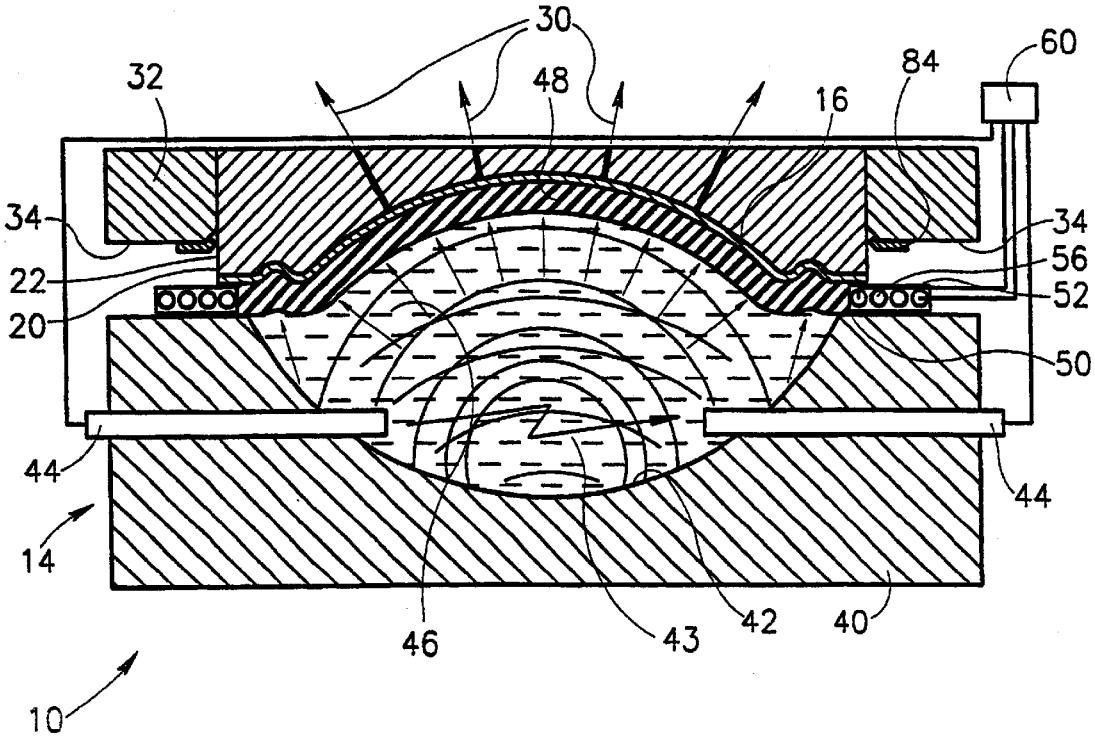
FIG. 2 is a schematic representation of the forming process.

Formed in mold 12 are a plurality of ducts 28 leading from depression 24 to a vacuum source (not shown) which draws gas from the depression (represented by arrows 30 in FIG. 2).

Mold 12 is surrounded by an annular member 32 which has an upper surface 34, at a distance from planar surface 18, and having a chamfered inner portion 36 for receiving and holding sheared material waste (see below).

Force generating assembly 14 comprises a PDF device, generally designated 40 comprising a fluid basin 42 holding fluid 43 having disposed therein a plurality of discharge electrodes 44 (two are shown in this cross-section but it can be appreciated that a larger number at varying locations within the basin may be provided). Fluid 43 is typically, but not exclusively a liquid, typically an aqueous solution. Fluid 43 may also, at times, be a gas. The basin has an opening 46 sealed by a flexible planar wall 48 extending over and fixed to edges 50 of the opening (the manner of fixing may be as known per se and is not shown).

The size of opening 46 is such so that it is opposite the major depression 24 of the mold and preferably also opposite other depressions, such as depression 26.

Force genearting assembly 14 further comprises a planar coil member 52 arranged so as to define a frame around opening 46 and has a face 54 which faces the metal plate which is in close proximity to metal plate 16. The position and size of coil member 54 is such so that it is opposite portion of plate 16 including such portions which are opposite edge 20 and extending peripherally therefrom. As will be appreciated, the forming coil 56 within forming coil member 52, should preferably be electrically insulated both from plate 16 as well as from other electrically conducting objects, such as the body of device 40 in case this is made of metal or another conducting substance. It is to be noted, however, that the body of the device is preferably made of a non-metallic rigid substance, of a rigidity such that it can withstand the pressure generated within basin 42) and accordingly it may be embedded in or covered by an electrically insulating material.

Electrodes 44 and forming coil 56 are electrically connected to an electric discharge circuitry 60.

Figure 4:
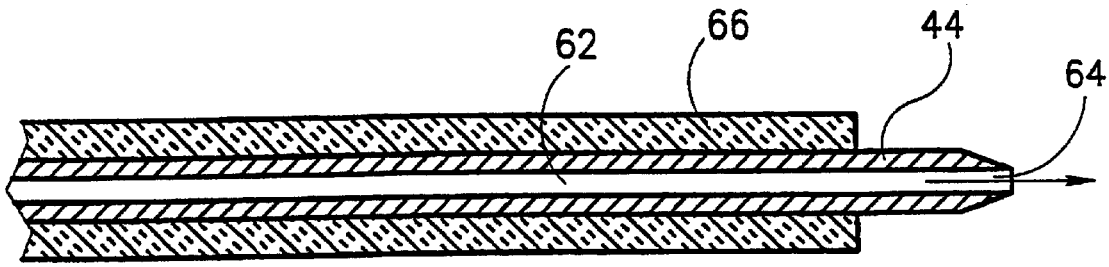
FIG. 4 is an enlarged cross-sectional view of the PDF electrode in the apparatus of FIG. 1.

A schematic representation of the structure of electrode 44 is shown in FIG. 4. Electrode 44 is formed from a metal tube with a lumen 62 having a tapered discharge end 64. The electrode is coated by an electrically insulating layer 66. Lumen 62 is connected to a gas source, e.g. air, which is supplied by a compressor or a compressed gas reservoir (not shown). Such gas flows into basin 42 facilitates the generation of electric discharge and the formation of plasma within liquid 43 (typically an aqueous solution) contained in basin 42. In some embodiments of the invention the electrode may comprise a single conductivity (non-gas transmitting) tip.

In the case of electrodes of the kind shown in FIG. 4, or electrodes comprising a single conducting tip, each pair of electric discharge members is constituted by two electrodes.

Figure 5:
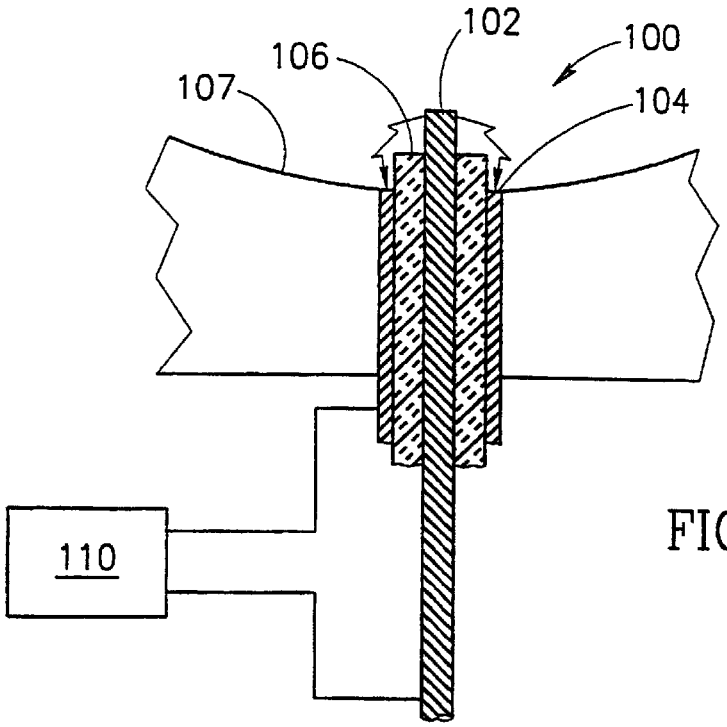
FIG. 5 is an enlarged cross-sectional view of a PDF electrode in accordance with another embodiment of the invention.

Another embodiment of an electrode 100 in accordance with the invention can be seen in FIG. 5. The electrode 100, of this embodiment, is a co-axial electrode with a central electrode member 102 and a peripheral annular electrode member 104, the two being isolated by an electrically non-conducting layer 106. Members 102 and 104 are connected to a discharge circuitry 110. In this way, upon discharge of the intense and rapid electric current pulse, a spark will be generated between pole 102 and pole 104.

It should be noted, that in some other embodiments, the body of the basin 107 may form one of the discharge members of a discharge pair and thus the discharge will be between an electrode and the body.

Figure 6:
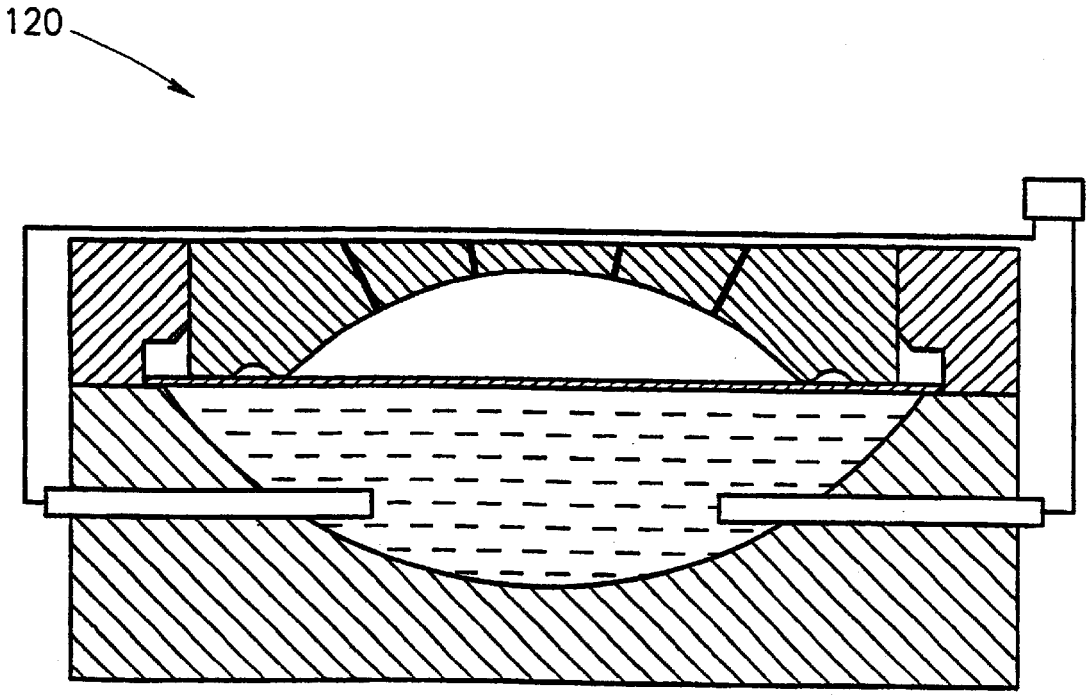
FIG. 6 is a schematic cross-section through a forming apparatus in accordance with another embodiment of the invention prior to forming the metal plate.

An apparatus 120 in accordance with another embodiment of the invention can be seen in FIG. 6. The apparatus 120 differs from apparatus 10 shown in FIG. 1 in that (i) it does not comprise a flexible wall and thus the fluid within the basin is in direct contact with the metal plate; and (ii) in that it does not comprise a peripheral shearing coil. In the case of apparatus 120 the pressure wave generated within the liquid hits the plate directly causing it to deform and shearing its peripheral portions.

Figure 7:
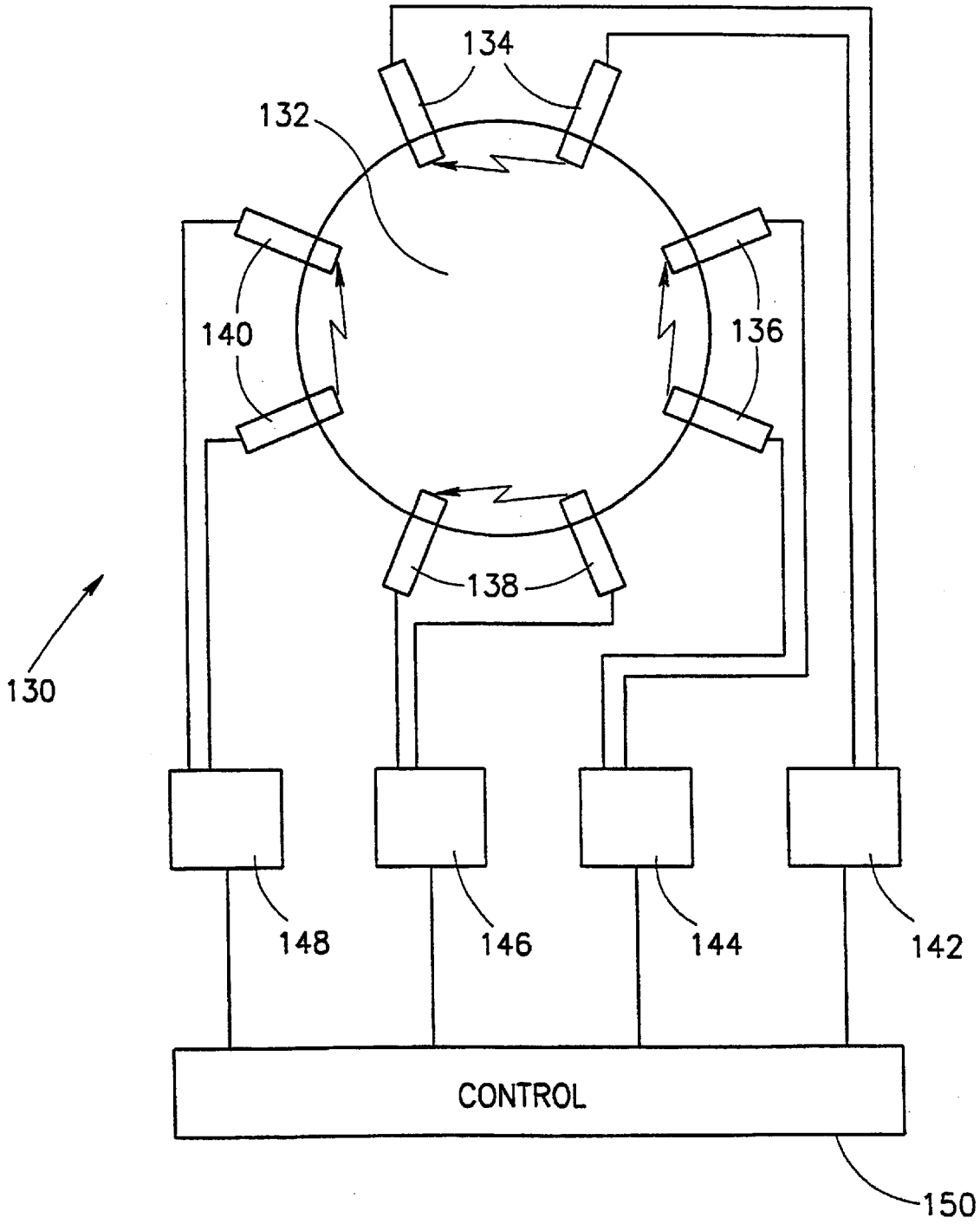
FIG. 7 is a schematic, planar representation of a forming apparatus in accordance with another embodiment of the invention.

Reference is now being made to FIG. 7 showing an apparatus generally designated 130 comprising a fluid basin 132 with a plurality of electrodes 134, 136, 138 and 140. Each pair of electrodes (134, 136, etc.) being connected to a corresponding discharge circuitry 142, 144, 146 and 148, respectively, which are under control of a control circuitry 150.

An electric current is discharged between each pair of electrodes and can be timed such that all discharges will be simultaneous or such that current will be discharged through different pairs in a predetermined sequence.

Figure 8A:
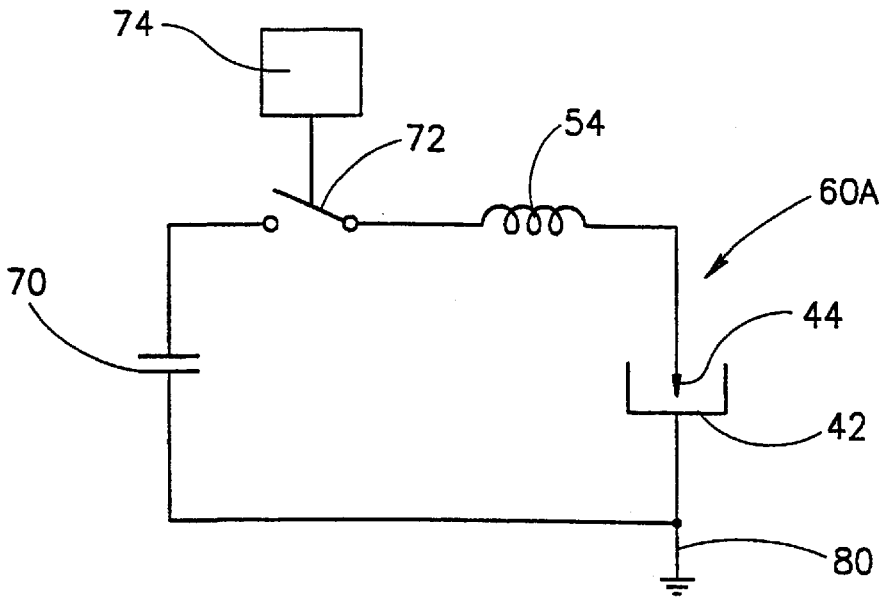
FIGS. 8A and 8B are schematic illustrations of two alternative electric circuitries for discharging the rapid intense electric current pulse through the PDF electrodes and through the forming coil in the apparatus of FIG. 1.
Figure 8B:
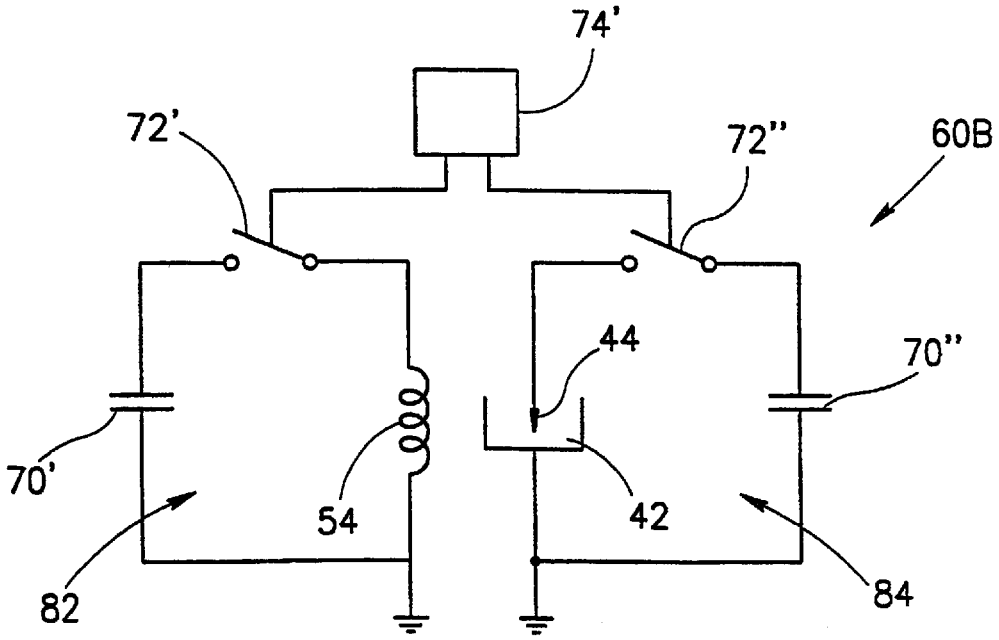

Two embodiments of electric discharge circuitries 60A and 60B, are shown in FIGS. 8A and 8B, respectively. Discharge circuitry 60A comprises an electric power source 70, which may be a capacitor or a bank of capacitors, a high current rapid discharge switch 72, e.g. a controlled vacuum discharger (which may be any such device known per se, or such as that disclosed in Israel Patent Application No. 119826 and its counterpart PCT Application No. PCT/IL97/00383) and a triggering unit 74 which actuates discharge of switch 72. The switch and the power source are connected in series with forming coil 54 and with electrodes 44 embedded within basin 42. The electric discharge circuitry is typically grounded at 80. Upon triggering by trigger units 74, switch 72 closes, thus giving rise to current discharge through coil 53 in electrodes 44.

In the case of the alternative electric circuitry 60*b* rather than having coil 54 and electrodes 44 connected in series, there are provided two parallel circuits 82 and 84, the first for discharging current through coil 54 and the latter for generating electric discharge through electrodes 44 within basin 42. The electric switches 70' and 70 in the two circuitries are triggered in parallel by a triggering unit 74'. Both electric circuities 82 and 84 have their independent power source 70' and 70 . Electric circuitry 60*b* shown in FIG. 5B is useful in the case of an impedance mismatch between the electrodes and the coil.

Figure 3:
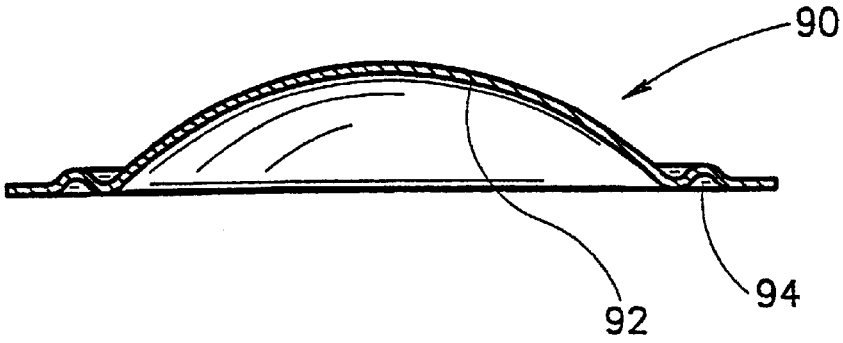
FIG. 3 is a cross-sectional view of a dish formed in the apparatus of FIG. 1 and by the illustrated process.

Referring back to FIG. 2, upon activating of electric circuitry 60, (or an alternative one such as that shown in FIG. 5B) current is simultaneously discharged through electrode 44 and coil 56 yielding generation of a spark within basin 42, causing plasma and vapor formation in liquid 43. This gives rise to a pressure wave applying pressure on flexible wall 48 which thereby deforms metal plate 16 in accordance with the template provided by the depressions in mold 12. The electric discharge through coil 56 gives rise to a pulsed magnetic force in the peripheral portions of the plate shearing these peripheral portions 84 off. Thus, a dish 90 with a central concave depression 92 and peripheral annular groove 94 is formed, as seen in FIG. 3. Such a dish is useful, for example, as an antenna, in particular such used in satellite communication.

Annular member 32 can then be pushed towards and beyond edge 20 to release the peripheral portion 84.

Figure 9:
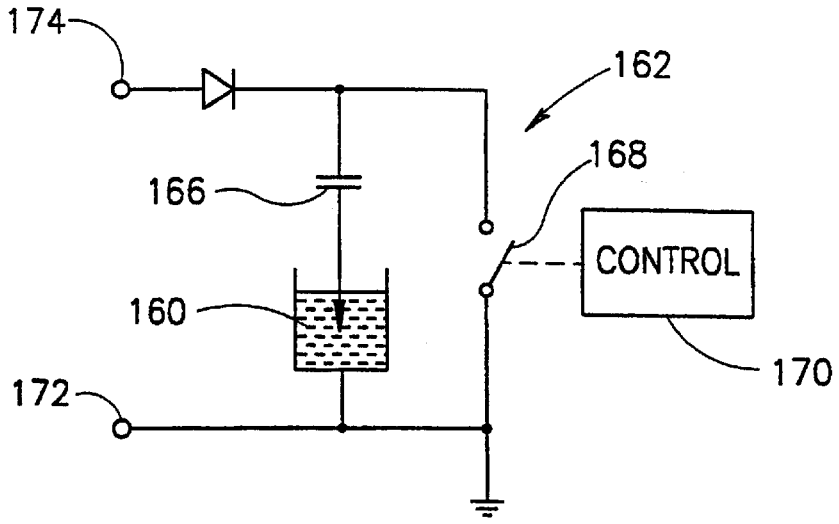
FIG. 9 shows a discharge-in-liquid (DIL) force generating apparatus with an electric circuitry in accordance with the invention.
Figure 10:
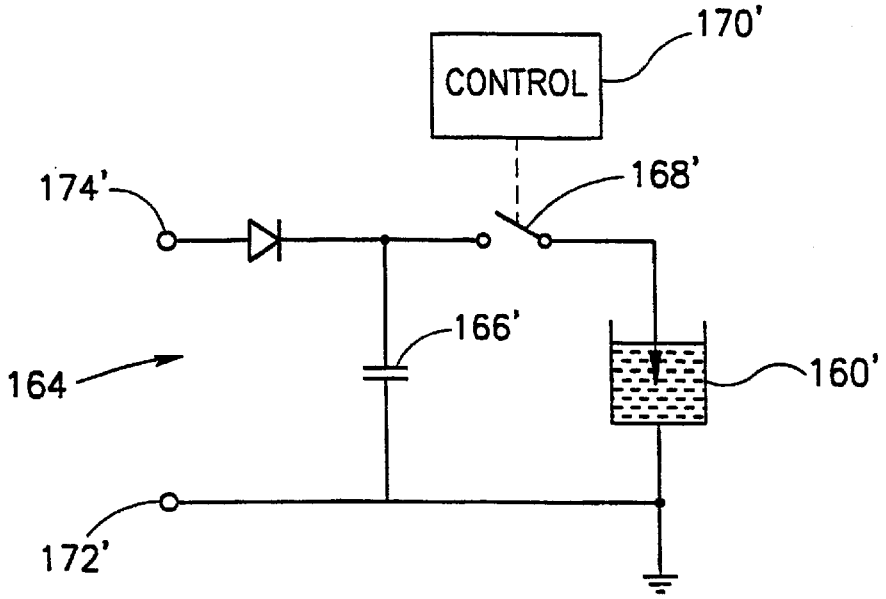
FIG.10 PRIOR ART
FIG. 10 shows a force generating DIL apparatus with a prior art electric discharge circuitry.
Figure 11:
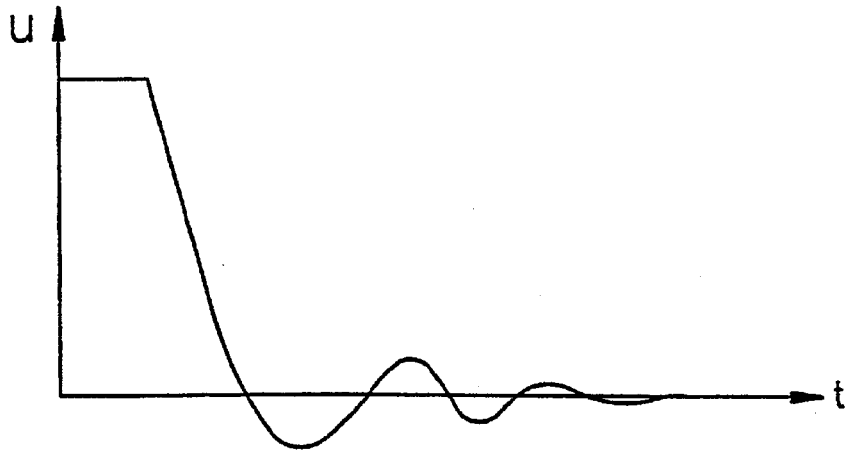
FIGS. 11 and 12 show, respectively, the electric voltage discharge profile through the apparatuses of FIGS. 9 and 10, respectively.
Figure 12:
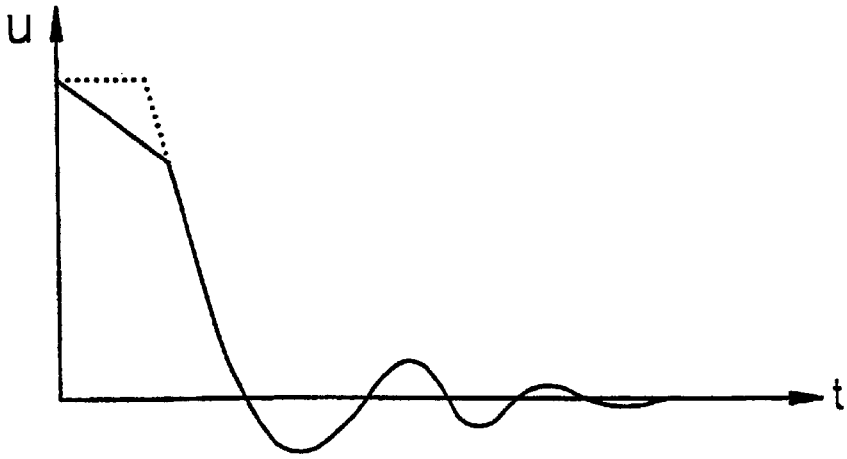
FIG.12 PRIOR ART

FIG. 9 shows a force generating device 160, wherein the generated force results from electric discharge within a liquid. The device 160 is connected to an electric discharge circuitry 162, in accordance with the invention. For comparison, reference may be made to FIG. 10 showing an identical device 160' connected to a prior art discharge circuitry 164. The advantage of the circuitry of FIG. 9 over that shown in FIG. 10 can be appreciated by comparing the change in potential over time, upon discharge, between FIG. 11 and 12 (prior art), respectively. In the electric discharge circuitry of FIG. 9, the capacitor battery 166 is connected in series with device 160 and both are connected in parallel to discharge switch 168, the latter being associated with controller 170. Electric charge from a power supply (represented by poles 172, 174) charges capacitor battery 166 and consequently there is always a constant potential build up, to the maximum level provided by the power supply, between discharge members pairs of device 160. Thus, when control circuitry 170 closes switch 168, the potential retains the maximum level and accordingly a maximal electric discharge is discharged between discharge members of device 160. However, in contrast thereto, in the prior art circuitry shown in FIG. 10 (the same reference numeral with a prime indicator have been used to indicate like components), as a result of defects in the electrodes or as a result of having a long electrode tip, there is leakage of current into the liquid and accordingly the maximal desired potential (represented by a dotted line in FIG. 12) is not attained and the spark is generated at a lower potential and thus the device would have an overall lower performance.

What is claimed is:

1. An apparatus for forming a generally planar metal plate into a dish with a three-dimensional pattern, the apparatus comprising:

a mold having a forming surface with a contour corresponding to said three-dimensional pattern, and having edges corresponding to boundaries of the dish, which edges are defined by side walls essentially perpendicular to the forming plane;

a forming device comprising a fluid basin and pairs of electric discharge members within the fluid and having an opening facing the mold to allow transmission of a pressure wave from the fluid to the metal plate; and an electric discharge circuitry for discharging a short and intense electric current through the pairs of electric discharge members generating an electric spark or breakdown within the fluid to yield formation of plasma, vapor or both, wherein the forming surface comprises depressions corresponding to said three-dimensional patterns, wherein said dish has a central concave portion and a peripheral skirt, and the forming surface has a peripheral annular depression for forming a peripheral annular groove in the skirt portion of the dish.

2. An apparatus for forming a generally planar metal plate into a dish with a three-dimensional pattern, the apparatus comprising:

a mold having a forming surface with a contour corresponding to said three-dimensional pattern, and having edges corresponding to boundaries of the dish, which edges are defined by side walls essentially perpendicular to the forming plane;

a forming device comprising a fluid basin and pairs of electric discharge members within the fluid and having an opening facing the mold to allow transmission of a pressure wave from the fluid to the metal plate; and an electric discharge circuitry for discharging a short and intense electric current through the pairs of electric discharge members generating an electric spark or breakdown within the fluid to yield formation of plasma, vapor or both, wherein the forming device comprises a planar forming coil member arranged so as to define a frame around said opening for deforming a peripheral portion of the plate, said coil member being connected to a discharge circuit for discharging an intense electric current therethrough.

3. An apparatus according to claim 2, wherein said coil member is situated opposite to said edges of said mold.

4. An apparatus for forming a generally planar metal plate into a dish with a three-dimensional pattern, the apparatus comprising:

a mold having a forming surface with a contour corresponding to said three-dimensional pattern, and having edges corresponding to boundaries of the dish, which edges are defined by side walls essentially perpendicular to the forming plane;

a forming device comprising a fluid basin and pairs of electric discharge members within the fluid and having an opening facing the mold to allow transmission of a pressure wave from the fluid to the metal plate; and an electric discharge circuitry for discharging a short and intense electric current through the pairs of electric discharge members generating an electric spark or breakdown within the fluid to yield formation of plasma, vapor or both, wherein the electric discharge in different discharge members is in accordance with a predetermined sequence.

5. A method for forming a general planar metal plate into a dish with a three-dimensional pattern, comprising:

(a) providing a mold having a forming surface with a contour corresponding to said three-dimensional pattern, and having edges corresponding to boundaries of the dish, which edges are defined by side walls essentially perpendicular to the forming plane;

(b) placing the metal plate over the forming surface of the mold;

(c) providing a forming device comprising a fluid basin and pairs of electric discharge members within the fluid and having an opening facing the mold, the pairs of electric discharge members being connected to an electric discharge circuitry;

(d) inducing said electric discharge circuitry to discharge a short pulse of an intense electric current through each of the pairs of electric discharge members, thus generating an electric spark or breakdown within the fluid creating a pressure wave in said fluid basin which deforms the metal plate against said mold, wherein the forming surface of the mold has a central concave depression defining and serving as a template for a central concave portion of the dish, the method further comprising:

(e) removing gasses from the depression, wherein the dish is formed with a generally planar skirt portion, and wherein the skirt portion is formed with an annular groove.

6. A method for forming a general planar metal plate into a dish with a three-dimensional pattern, comprising:

(a) providing a mold having a forming surface with a contour corresponding to said three-dimensional pattern, and having edges corresponding to boundaries of the dish, which edges are defined by side walls essentially perpendicular to the forming plane;

(b) placing the metal plate over the forming surface of the mold;

(c) providing a forming device comprising a fluid basin and pairs of electric discharge members within the fluid and having an opening facing the mold, the pairs of electric discharge members being connected to an electric discharge circuitry;

(d) inducing said electric discharge circuitry to discharge a short pulse of an intense electric current through each of the pairs of electric discharge members, thus generating an electric spark or breakdown within the fluid creating a pressure wave in said fluid basin which deforms the metal plate against said mold, and discharging a short pulse of an intense electric current through the forming coil wherein said forming device comprises a planar forming coil member arranged so as to define a frame around said opening for deforming a peripheral portion of the plate, said coil member being connected to a discharge circuit for discharging an intense electric current therethrough.

7. A method for forming a general planar metal plate into a dish with a three-dimensional pattern, comprising:

(a) providing a mold having a forming surface with a contour corresponding to said three-dimensional pattern, and having edges corresponding to boundaries of the dish, which edges are defined by side walls essentially perpendicular to the forming plane;

(b) placing the metal plate over the forming surface of the mold;

(c) providing a forming device comprising a fluid basin and pairs of electric discharge members within the fluid and having an opening facing the mold, the pairs of electric discharge members being connected to an electric discharge circuitry;

(d) inducing said electric discharge circuitry to discharge a short pulse of an intense electric current through each of the pairs of electric discharge members, thus generating an electric spark or breakdown within the fluid creating a pressure wave in said fluid basin which deforms the metal plate against said mold, wherein the fluid basin comprises a plurality of pairs of electric discharge members, and wherein the electric discharge in different discharge members is in accordance with a predetermined sequence.

* * * * *